US008008871B2

(12) United States Patent
Wang et al.

(10) Patent No.: US 8,008,871 B2
(45) Date of Patent: Aug. 30, 2011

(54) METHOD FOR CONTROLLING A DRIVING CIRCUIT OF A LIGHT-EMITTING DEVICE AND RELATED ELECTRONIC DEVICE AND LIGHT SOURCE SYSTEM

(75) Inventors: Chun-Chuan Wang, Taipei (TW); Chun-Ta Chen, Hsinchu County (TW)

(73) Assignees: AMIC Technology Corporation, Science-Based Industrial Park, Hsin-Chu (TW); Power Up, Inc., Jhubei, Hsin-chu County (TW)

( * ) Notice: Subject to any disclaimer, the term of this patent is extended or adjusted under 35 U.S.C. 154(b) by 625 days.

(21) Appl. No.: 12/191,293

(22) Filed: Aug. 13, 2008

(65) Prior Publication Data

US 2009/0309506 A1 Dec. 17, 2009

(30) Foreign Application Priority Data

Jun. 16, 2008 (TW) ..... 97122399 A

(51) Int. Cl.
*G05F 1/00* (2006.01)

(52) U.S. Cl. ..... 315/307; 315/291; 315/169.1; 315/169.3; 345/690; 345/691; 345/77; 345/82

(58) Field of Classification Search ..... 315/291, 315/307, 308, 169.1, 169.3, 312; 345/42, 345/76, 77, 82, 204, 690, 691
See application file for complete search history.

(56) References Cited

U.S. PATENT DOCUMENTS

| | | | | |
|---|---|---|---|---|
| 6,677,713 | B1 * | 1/2004 | Sung | 315/169.1 |
| 7,202,613 | B2 * | 4/2007 | Morgan et al. | 315/312 |
| 7,646,029 | B2 * | 1/2010 | Mueller et al. | 257/84 |
| 7,738,002 | B2 * | 6/2010 | Ashdown et al. | 345/691 |

* cited by examiner

*Primary Examiner* — Haiss Philogene
(74) *Attorney, Agent, or Firm* — Winston Hsu; Scott Margo

(57) ABSTRACT

A method for controlling a driving circuit of a light-emitting device is disclosed. The driving circuit is utilized for transforming an input power into a driving power for the light-emitting device according to a plurality of state values. The method includes receiving the input power, outputting a first state value of the plurality of state values to the driving circuit, and outputting a second state value of the plurality of state values to the driving circuit according to variation of the input power.

19 Claims, 4 Drawing Sheets

METHOD FOR CONTROLLING A DRIVING CIRCUIT OF A LIGHT-EMITTING DEVICE AND RELATED ELECTRONIC DEVICE AND LIGHT SOURCE SYSTEM

BACKGROUND OF THE INVENTION

1. Field of the Invention

The present invention relates to a method for controlling a driving circuit of a light-emitting device and related electronic device and light source system, and more particularly, to a method and related electronic device and light source system for generating a light source of specific luminance and chrominance by controlling turn-off time of power.

2. Description of the Prior Art

In daily life, people need to change luminance and chrominance of light depending on different environment. For example, soft light is needed when dining, whereas bright but not harsh light is needed when reading. Therefore, the prior art provides different operations for users to control light conveniently, such that users can change luminance and chrominance of light emitted by a light-emitting device, e.g. a light emitting diode, via a switch. Since luminance and chrominance of light emitted by the light-emitting device are related to amplitude or duty cycle of an input power, the switch can be designed to vary amplitude or duty cycle of the input power, so as to realize the purpose of changing luminance and chrominance. In addition, changing duty cycle is usually realized by angular modulation, such as pulse width modulation (PWM).

Please refer to FIG. 1. FIG. 1. is a schematic diagram of a light source system 10 in the prior art. The light source system 10 comprises a light-emitting device 100, a switch device 102 and a pulse width modulation device 104. The light-emitting device 100 can be a light emitting diode, and is utilized for generating a light source according to received power. The switch device 102 can be an on-off switch, and is utilized for receiving control signals triggered by a user and transmitting the control signals to the pulse width modulation device 104. The pulse width modulation device 104 is utilized for transforming an input signal VIN into an output signal VOUT according to signals provided by the switch device 102, and transmitting the output signal VOUT to the light-emitting device 100 to emit light. When the user needs to control luminance and chrominance emitted by the light-emitting device 100, the user can adjust pulse width of the output signal VOUT, namely T1, via the switch device 102, to make the light-emitting device 100 to emit required light.

Via the pulse width modulation device 104, the user can adjust luminance and chrominance of the light source system 10. However, a circuitry of the pulse width modulation device 104 is more complicated, resulting in high production cost which limits its applications.

SUMMARY OF THE INVENTION

It is therefore a primary objective of the claimed invention to provide a method for controlling a driving circuit of a light-emitting device and related electronic device and light source system.

The present invention discloses a method for controlling a driving circuit of a light-emitting device. The driving circuit is utilized for transforming an input power into a driving power for the light-emitting device according to a plurality of state values. The method comprises receiving the input power, outputting a first state value of the plurality of state values to the driving circuit, and outputting a second state value of the plurality of state values to the driving circuit according to variation of the input power.

The present invention further discloses an electronic device for controlling a driving circuit of a light-emitting device. The driving circuit is utilized for transforming an input power into a driving power for the light-emitting device according to a plurality of state values. The electronic device comprises a reception end for receiving the input power, and a state machine coupled between the reception end and the driving circuit, for outputting a first state value of the plurality of state values to the driving circuit and outputting a second state value of the plurality of state values to the driving circuit according to variation of the input power.

The present invention further discloses a light source system, which comprises a power reception end, a switch device, a light-emitting device, a driving circuit and a control device. The power reception end is coupled to a first power. The switch device is coupled to the power reception end for switching output status of the first power to generate a second power. The light-emitting device is utilized for generating a light source according to a driving power. The driving circuit is coupled between the switch device and the light-emitting device, for transforming the second power into the driving power for the light-emitting device according to a plurality of state values. The control device comprises a reception end coupled to the switch device, for receiving the second power, and a state machine coupled between the reception end and the driving circuit, for outputting a first state value of the plurality of state values to the driving circuit and outputting a second state value of the plurality of state values to the driving circuit according to variation of the second power.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
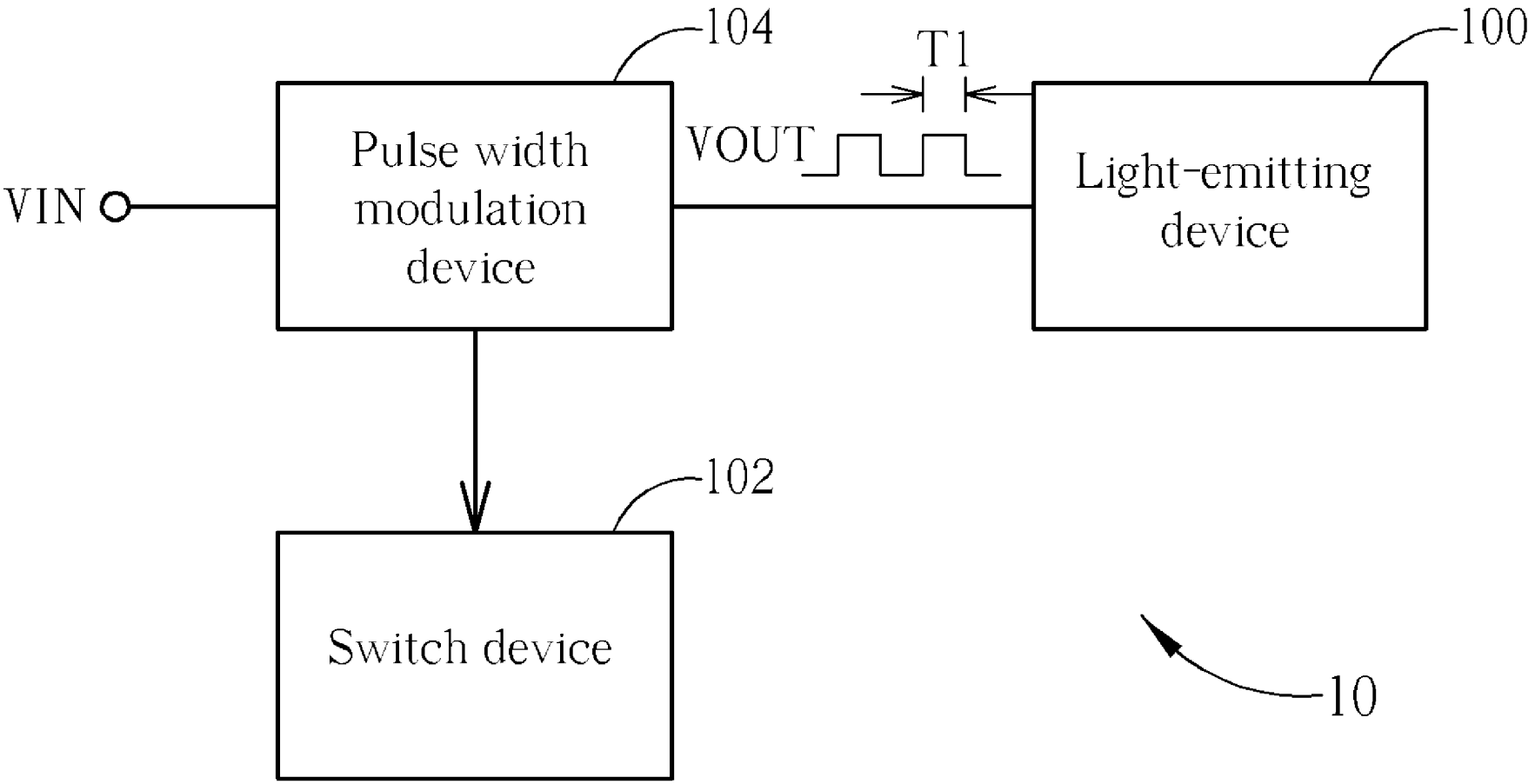
FIG. 1 PRIOR ART
FIG. 1. is a schematic diagram of a light source system in the prior art.
Figure 2:
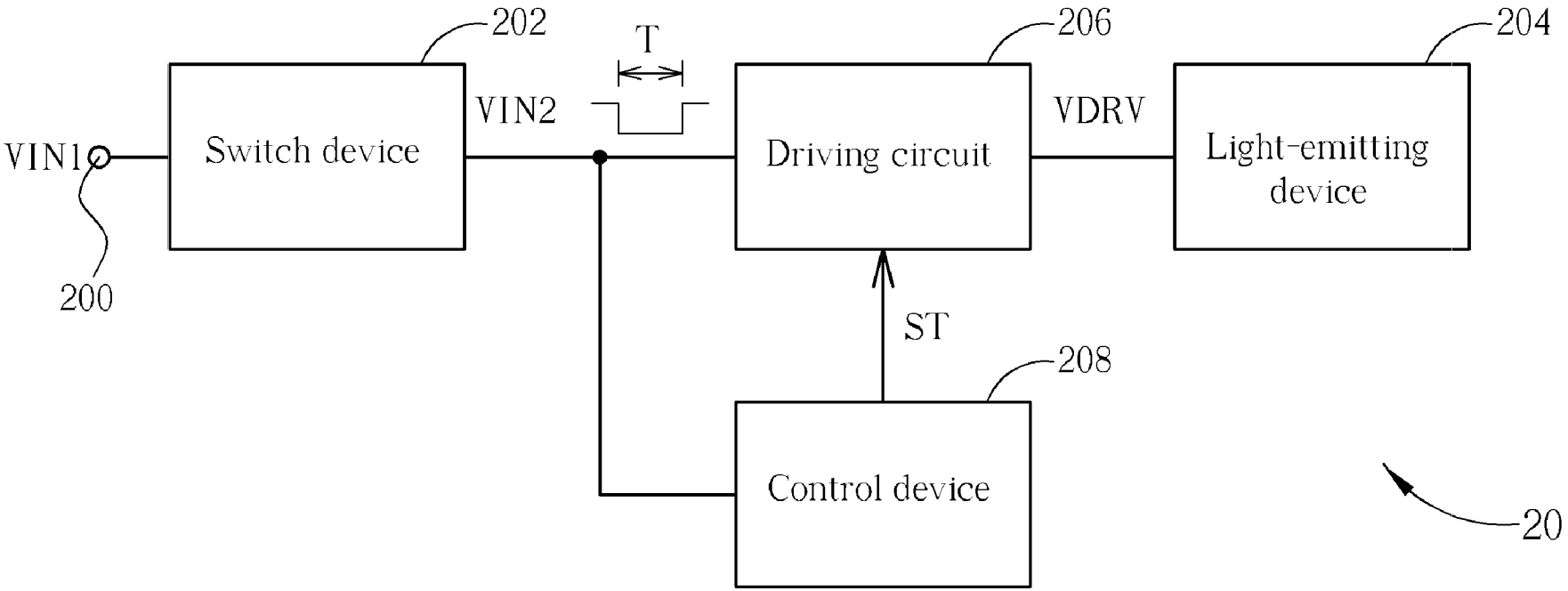
FIG. 2 is a schematic diagram of a light source system according to an embodiment of the present invention.

Please refer to FIG. 2. FIG. 2 is a schematic diagram of a light source system 20 according to an embodiment of the present invention. The light source system 20 comprises a power reception end 200, a switch device 202, a light-emitting device 204, a driving circuit 206 and a control device 208. The power reception end 200 is coupled to a first power VIN1, e.g. a household AC power or a power generated by a power supply. The switch device 202 is coupled to the power reception end 200, and is utilized for switching output status of the first power VIN1 to generate a second power VIN2. The light-emitting device 204 is preferably a light emitting diode. The control device 208 is utilized for outputting a state value ST to the driving circuit 206 and adjusting the state value ST according to variation of the second power VIN2. The driving circuit 206 is coupled to the switch device 202, the light-emitting device 204 and the control device 208, and comprises a plurality of patterns of the driving power VDRV. Each pattern of the driving power VDRV is corresponding to a state value ST, which is utilized for driving the light-emitting device 204 to generate light of specific luminance and chrominance. In other words, the driving circuit 206 is capable of transforming the second power VIN2 into an appropriate driving power VDRV according to the state value ST generated by the control device 208, so as to drive the light-emitting device 204 to emit required light.

Figure 3:
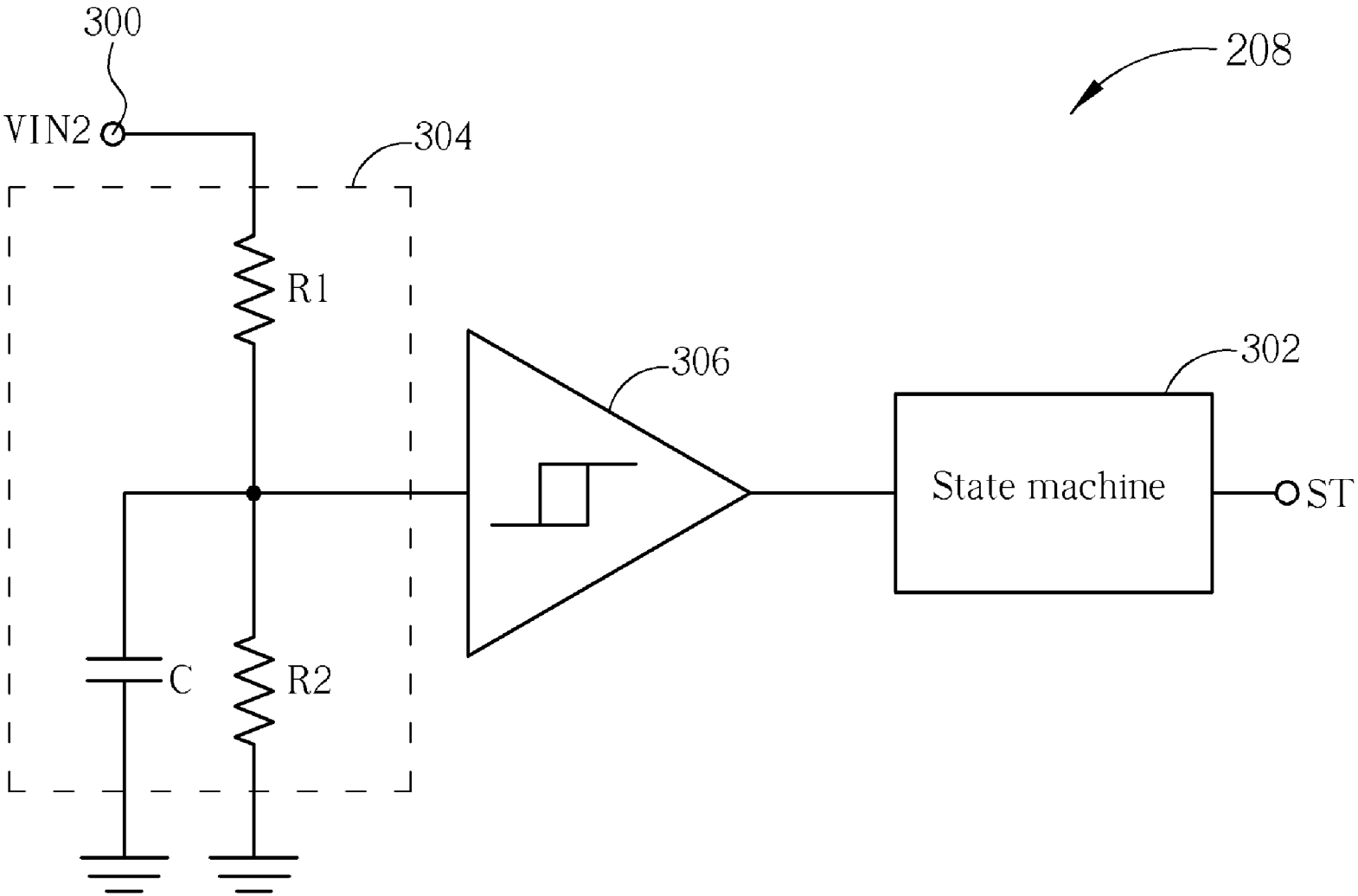
FIG. 3 is a schematic diagram of the control device in FIG. 2 according to a preferable embodiment of the present invention.

In FIG. 2, preferably, the control device 208 adjusts the state value ST according to a turn-off time T of the second power VIN2, so as to control the driving circuit 206 to generate the driving power VDRV. In such a case, a user can adjust the state value ST by switching the turn-off time T of the second power VIN2 via the switch device 202. Moreover, the control device 208 can also adjust the state value ST according to a number of turn-off times of the second power VIN2, so as to control the driving circuit 206 to generate the driving power VDRV. Please continue to refer to FIG. 3. FIG. 3 is a schematic diagram of the control device 208 shown in FIG. 2 according to a preferable embodiment of the present invention. The control device 208 comprises a reception end 300, a state machine 302, a filter unit 304 and a Schmitt Trigger unit 306. The second power VIN2 is received by the control device 208 via the reception end 300, and is outputted to the state machine 302 via the Schmitt Trigger unit 306 after filtered by the filter unit 304, which is composed of resistors R1, R2 and a capacitor C. The state machine 302 can output and adjust the state value ST according to variation of the second power VIN2.

Figure 4:
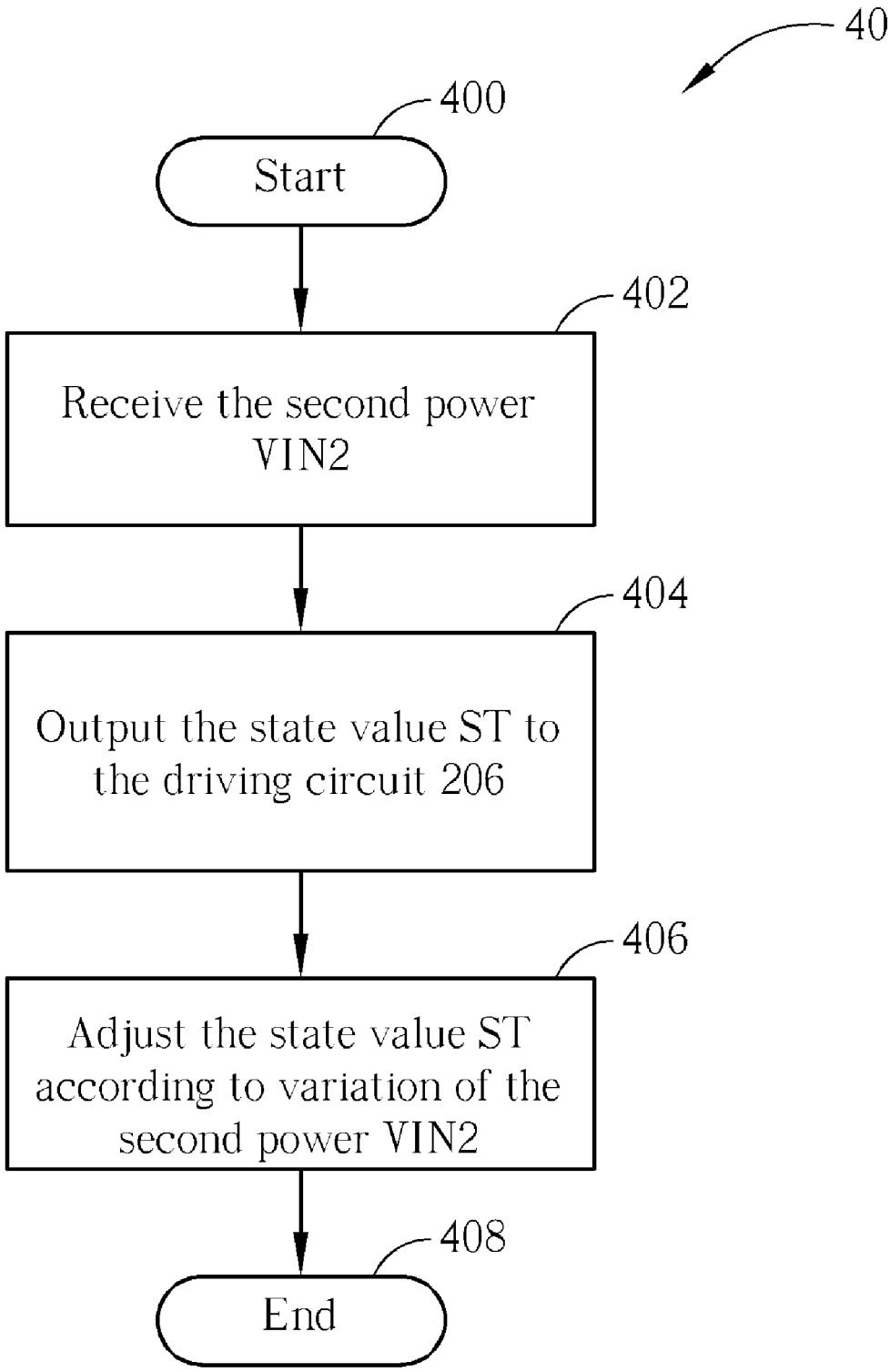
FIG. 4 is a schematic diagram of an operation procedure for the control device according to an embodiment of the present invention.

Please refer to FIG. 4. FIG. 4 is a schematic diagram of an operation procedure 40 for the control device 208 according to an embodiment of the present invention. The operation procedure 40 comprises the following steps:

Step 400: Start.

Step 402: Receive the second power VIN2.

Step 404: Output the state value ST to the driving circuit 206.

Step 406: Adjust the state value ST according to variation of the second power VIN2.

Step 408: End.

According to the operation procedure 40, the control device 208 adjusts the state value ST according to variation of the second power VIN2. Preferably, the control device 208 adds a predetermined difference value, e.g. 1, to the state value ST when turn-off time T of the second power VIN2 is less than a predetermined value, whereas the state value ST is set to an initial value when turn-off time T of the second power VIN2 is more than the predetermined value. In other words, if a user switches the switch device 202 so rapidly that turn-off time T of the second power VIN2 is less than the predetermined value, the control device 208 can adjust the state value ST to be what the original value adds 1. That is, the driving circuit 206 is controlled to switch to the next pattern of the driving power VDRV. Meanwhile, if the original state value ST reaches the maximum, the state value ST added 1 will begin from another cycle, or saying, back to the minimum. On the contrast, if the user turns off the light source system 20, which means that turn-off time T of the second power VIN2 is more than the predetermined value, the state value ST will change from the predetermined initial value when the user turns on the light source system 20 next time. Besides, in step 406, the state value ST can also be adjusted according to the number of turn-off times of the second power VIN2. For example, when the number of turn-off times of the second power VIN2 is 3, the state value ST is added 3, so as to switch the driving power VDRV rapidly and drive the light-emitting device 204 to emit required light.

Therefore, in the light source system 20, the driving circuit 206 is preset to comprise a plurality of patterns of the driving power VDRV. Each pattern of the driving power VDRV is utilized for driving the light-emitting device 204 to generate light of specific luminance and chrominance. The user can change the turn-off time or the number of turn-off times of the second power VIN2 via the switch device 202 to adjust the state value ST, thereby controlling the driving circuit 206 to output a specific pattern of the driving power VDRV to drive the light-emitting device 204 to emit required light. In other words, in the present invention, the user can control the light-emitting device 204 to emit required light by using the switch device 202 to change the turn-off time or the number of turn-off times of the second power VIN2. In addition, the control device 208 is mainly composed of the state machine 302, resulting in lower production cost. More important, the user can adjust luminance and chrominance simultaneously simply by switching the switch device 202. In comparison, in the prior art, adjustments of luminance and chrominance are usually implemented by different switches, and circuits thereof, e.g. PWM circuits, are more complicated as well.

In conclusion, the present invention controls the driving circuit to generate a specific pattern of the driving power by controlling turn-off time of the power, causing the light-emitting device to generate a light source of specific luminance and chrominance.

Those skilled in the art will readily observe that numerous modifications and alterations of the device and method may be made while retaining the teachings of the invention.

What is claimed is:

1. A method for controlling a driving circuit of a light-emitting device, the driving circuit being utilized for transforming an input power into a driving power for the light-emitting device according to a plurality of state values, the method comprising:

receiving the input power;

outputting a first state value of the plurality of state values to the driving circuit; and outputting a second state value of the plurality of state values to the driving circuit according to variation of the input power.

2. The method of claim 1, wherein outputting the second state value of the plurality of state values to the driving circuit according to variation of the input power is setting the second state value to be a sum of the first state value and a predetermined difference value, and outputting the second state value to the driving circuit when turn-off time of the input power is less than a predetermined value.

3. The method of claim 2, wherein when the first state value is a maximum of the plurality of state values, the second state value is a minimum of the plurality of state values.

4. The method of claim 1, wherein outputting the second state value of the plurality of state values to the driving circuit according to variation of the input power is setting the second state value to be an initial value, and outputting the second state value to the driving circuit when turn-off time of the input power is more than a predetermined value.

5. The method of claim 1, wherein outputting the second state value of the plurality of state values to the driving circuit according to variation of the input power is setting the second state value to be a sum of the first state value and a difference value corresponding to a number of turn-off times of the input power, and outputting the second state value to the driving circuit, according to the number of turn-off times of the input power.

6. An electronic device for controlling a driving circuit of a light-emitting device, the driving circuit being utilized for transforming an input power into a driving power for the light-emitting device according to a plurality of state values, the electronic device comprising:

a reception end for receiving the input power;

a state machine coupled between the reception end and the driving circuit, for outputting a first state value of the plurality of state values to the driving circuit and outputting a second state value of the plurality of state values to the driving circuit according to variation of the input power.

7. The electronic device of claim 6, wherein the state machine sets the second state value to be a sum of the first state value and a predetermined difference value, and outputs the second state value to the driving circuit when turn-off time of the input power is less than a predetermined value.

8. The electronic device of claim 7, wherein when the first state value is a maximum of the plurality of state values, the second state value is a minimum of the plurality of state values.

9. The electronic device of claim 6, wherein the state machine sets the second state value to be an initial value, and outputs the second state value to the driving circuit when turn-off time of the input power is more than a predetermined value.

10. The electronic device of claim 6, wherein the state machine sets the second state value to be a sum of the first state value and a difference value corresponding to a number of turn-off times of the input power, and outputs the second state value to the driving circuit according to the number of turn-off times of the input power.

11. The electronic device of claim 6 further comprising a filter unit coupled between the reception end and the state machine, for filtering the input power.

12. The electronic device of claim 6 further comprising a Schmitt Trigger unit coupled between the reception end and the state machine.

13. A light source system comprising:

a power reception end coupled to a first power;

a switch device coupled to the power reception end, for switching output status of the first power to generate a second power;

a light-emitting device for generating a light source according to a driving power;

a driving circuit coupled between the switch device and the light-emitting device, for transforming the second power into the driving power for the light-emitting device according to a plurality of state values; and a control device comprising:

a reception end coupled to the switch device, for receiving the second power; and a state machine coupled between the reception end and the driving circuit, for outputting a first state value of the plurality of state values to the driving circuit and outputting a second state value of the plurality of state values to the driving circuit according to variation of the second power.

14. The light source system of claim 13, wherein the state machine sets the second state value to be a sum of the first state value and a predetermined difference value, and outputs the second state value to the driving circuit when turn-off time of the input power is less than a predetermined value.

15. The light source system of claim 14, wherein when the first state value is a maximum of the plurality of state values, the second state value is a minimum of the plurality of state values.

16. The light source system of claim 13, wherein the state machine sets the second state value to be an initial value, and outputs the second state value to the driving circuit when turn-off time of the input power is more than a predetermined value.

17. The light source system of claim 13, wherein the state machine sets the second state value to be a sum of the first state value and a difference value corresponding to a number of turn-off times of the second power, and outputs the second state value to the driving circuit according to the number of turn-off times of the second power.

18. The light source system of claim 13, wherein the control device further comprises a filter unit coupled between the reception end and the state machine, for filtering the second power.

19. The light source system of claim 13, wherein the control device further comprises a Schmitt Trigger unit coupled between the reception end and the state machine.

* * * * *